US006739491B2

(12) United States Patent
Hirai

(10) Patent No.: US 6,739,491 B2
(45) Date of Patent: May 25, 2004

(54) LOCK MEMBER ATTACHMENT DEVICE

(75) Inventor: Tomoyuki Hirai, Chibasi (JP)

(73) Assignee: Kabushiki-Kaisya Toska, Tokyo (JP)

( * ) Notice: Subject to any disclaimer, the term of this patent is extended or adjusted under 35 U.S.C. 154(b) by 0 days.

(21) Appl. No.: 10/126,387

(22) Filed: Apr. 19, 2002

(65) Prior Publication Data

US 2002/0183700 A1 Dec. 5, 2002

(30) Foreign Application Priority Data

May 21, 2001 (JP) ..... 2001-150709
Jul. 18, 2001 (JP) ..... 2001-217569

(51) Int. Cl.[7] ..... B25C 1/14
(52) U.S. Cl. ..... 227/67
(58) Field of Search ..... 227/67, 68, 69, 227/70, 71, 72, 73, 74, 75, 76

(56) References Cited

U.S. PATENT DOCUMENTS 3,650,452 A * 3/1972 Finke ..... 227/67
4,040,555 A * 8/1977 Jenkins ..... 227/67
4,049,179 A * 9/1977 Jenkins ..... 227/67
D271,178 S * 11/1983 Suzuki ..... D8/51
4,664,306 A * 5/1987 Levy ..... 227/67
4,838,469 A * 6/1989 Strausburg ..... 227/67
4,877,172 A * 10/1989 Franklin et al. ..... 227/69
4,971,238 A * 11/1990 Furutsu ..... 227/2
5,398,859 A * 3/1995 Lee ..... 227/67
5,529,233 A * 6/1996 Davignon et al. ..... 227/67
5,878,935 A * 3/1999 Furutsu ..... 227/67
5,906,039 A * 5/1999 Fukami et al. ..... 29/566
6,267,285 B1 * 7/2001 Raymond et al. ..... 227/67

* cited by examiner

*Primary Examiner*—Rinaldi I. Rada
*Assistant Examiner*—Paul Durand
(74) *Attorney, Agent, or Firm*—Frishauf, Holtz, Goodman & Chick, P.C.

(57) ABSTRACT

A lock member attachment device with a needle guard installation structure includes a needle guard having a pair of fork-like attachment pieces at a basal portion thereof, and a boxlike needle receiving portion at least at an upper surface thereof. The needle receiving portion is at a front portion of an attachment piece. The pair of attachment pieces are pivotally supported on an area near a front end of a main body casing, and at least one of the attachment pieces is acted on by a slider-type stopper, thereby retaining a predetermined position. The needle receiving portion has a cut groove formed in a bottom portion thereof, the cut groove being for restraining a discharged runner portion of a tag suspending member assembly when the needle guard is collapsed in use, so that a finger holding a grip of the main body will not contact the runner portion.

2 Claims, 10 Drawing Sheets

LOCK MEMBER ATTACHMENT DEVICE

BACKGROUND OF THE INVENTION

1. Field of the Invention

This invention relates to an installation structure of a needle guard in a lock member attachment device, and more particularly to an installation structure of a needle guard which is provided on an attachment tool for attaching a tag suspending member having an escape preventing member at each end of a fiber in order to retain a tag indicative of price, quality, etc. on a merchandise such as clothing in a suspending manner, by using an assembly of the tag suspending member. Also, the present invention relates to an attachment device for attaching a lock member having an escape preventing rod portion which is disposed in a crossing relation at generally right angles with respect to one end of a fiber formed from soft plastics and a piece-like head portion disposed at the other end, and more particularly to an attachment device for attaching a lock member for retaining, in a suspending manner, a tag indicative of price, quality, etc. of a merchandise such as clothing.

2. Related Art

Recently, in the case where a tag indicative of price, quality, etc. is retained, in a suspending manner, on a merchandise such as clothing, a suspending member using a fiber material made of plastics, which is unable to cut off without a need of a cutter, was used, instead of a conventional thread, because of its workability of attachment. This suspending member is of the type in which an escape preventing member is integrally provided on each end of a fiber portion. Recently, a specific attachment device was used as an assembly in which the suspending member is arranged in parallel to a runner.

This attachment device is of a handy type whose grip can be grasped with its user's single hand. In operation, a trigger lever is triggered to actuate a hollow needle which is attached to a distal end of the device and which is operatively connected to the trigger lever through an internal mechanism, thereby separating one of the suspending members loaded as an assembly from the runner. The separated suspending member is fed in synchronism with the piercing motion of the needle into the clothing, etc. so that a tag can be attached. The assembly is fed at a pitch of every suspending member by an internal mechanism. Since the hollow needle is preliminarily pierced into an objective matter, an escape preventing rod part is fed to the other side of the objective matter. Moreover, since the hollow needle is provided with a slit for allowing a fiber to depart therethrough, the fiber is separated, in the form of a single unit, from the attachment device. The connector member for connecting the runner is cut when it is pressed by the piston member.

Then, at the time of restoration to the initial state by releasing the trigger lever, feed means such as a gear, a claw member or the like is driven to feed one piece portion of the assembly and standby for the next operation.

In this conventional attachment device, the sharp needle is lef exposed even when the device is not in use. Therefore, there is such a risk that the human body and merchandise are pierced by the sharp needle. For the sake of protection, a protection cap was conventionally employed when the device is not in use. However, the protection cap is easily lost by missing. If a string or the like is employed for preventing the missing of the projection cap, operation is often interrupted by the string or the like. For this reason, it is also frequently occurred that the projection cap is unintentionally left unused.

It is customary that the runner is fed down, namely, in front of the user's finger holding the grip portion after the suspending member is cut. Depending on angle, etc. at the time of use of the device, a projection remained after cutting the suspending member contacts the user's finger, thereby providing pain and displeasure. To avoid it, several proposals were made for employment of a special guard member. However, any one of them required much elaboration and interference occurred at the time of storing the device when not in use. Moreover, the proposed device as a whole is degraded in outer appearance. In addition, the conventional lock member attachment device is sometimes sacrificed in precision. And the lock member is frequently clogged and the final press feeding operation by the piston member is degraded in reliability.

The present invention has be accomplished in view of the above-mentioned problems.

SUMMARY OF THE INVENTION

It is, therefore, an object of the present invention to provide a needle guard installation structure which has a compact needle guard capable of making a pivotal movement, which needle guard is capable of receiving the needle so as to prevent the user's finger from being injured when the device is not in use, which needle guard is pivotally moved so as to bee used as a member for guarding the user's finger from a risky contact with a runner when the device is in use, and which needle guard can be fixedly positioned at each position by a stopper, and in which a used-up runner portion of a tag suspending member assembly can be prevented from scattering in the nearby area, and to provide a lock member attachment device for enhancing precision and reliability, providing a comfortable sense of operation.

To achieve the above object, there is provided a lock member attachment device including a needle guard installation structure comprising a needle guard having a pair of fork-like attachment pieces disposed at a basal portion thereof and a box-like needle receiving portion at least at an upper surface thereof, which needle receiving portion is disposed at a front portion of the attachment piece, the pair of attachment pieces of the needle guard being pivotally supported on an area near a front end of a main body casing, and at least one of the pair of attachment pieces being acted by a stopper, thereby retaining a predetermined position, the needle receiving portion having a cut groove formed in a bottom surface thereof, the cut groove being for restraining a discharged runner portion of a tag suspending member assembly when the needle guard is collapsed in use, so that a finger holding a grip of the main body will not contact the runner portion, the cut groove of the needle guard having a guide taper formed in an inlet portion thereof, the guide taper being adapted to guide the runner portion for easy setting, the needle guard being partly provided with a control portion for pivotally moving the needle guard, and the pair of attachment pieces being formed in a parallel-shape which is declined rearward and downward to form an obtuse angle.

There is also provided a lock member attachment device including a needle guard installation structure, wherein the stopper is of a slider type having a chevron shape at a front end thereof and being biased by a coiled spring, a side portion of the attachment piece being restrained by any one of the side portions of the chevron shaped stopper.

There is further provided a lock member attachment device including a needle guard installation structure, wherein the stopper has a front end connected to a part of the attachment piece and a rear end serving as a free end having a spring property, the stopper being integrally provided at an upper edge of the free end with a generally rectangular acting portion, any one of the side portions of the acting portion being locked to a lock pin projecting from the main body casing, thereby conducting a correct positioning a runner stopper having a spring property being disposed at an area in the vicinity of the cut groove, the runner stopper being for preventing a used-up runner portion of the tag suspending member assembly from falling down, a piston member pierced into a needle being actuated by an arm which is turned by a trigger lever and a feed mechanism for feeding, one by one, a loaded lock member assembly is actuated, wherein the feed mechanism comprises a pinion member engaged for rotation with a rack which is formed on an upper surface of a front end of a slider member which is tension biased by a spring and actuated by an arm, an elevating member on which a rack is formed and which is engaged with the pinion member, a feed claw member pivotally moved in accordance with action of the elevating member, and a stopper member, teeth of the pinion member being formed on a surface having a 180 degrees or less of a main body peripheral surface.

There is also provided a lock member attachment device in which a coiled spring for tension biasing an arm is supported on rings which are vertically arranged in symmetrical relation, the upper ring is eccentrically supported by a spring connector, and the coiled spring is twisted by tilting motion of the spring connector.

There is further provided a lock member attachment device in which a casing has a swollen slit preventing portion formed on a part of an outer surface thereof.

Owing to the above-mentioned constitution of the present invention, the structure is compact and simple. Merely by simple operation for actuating the stopper, a guard from the needle at the time of non-use and a guard from contact between the runner and the user's finger at the time of use can be switched from one to the other. That is, the needle guard as a single member is always effective irrespective of use or non-use of the attachment device. The assembly of the lock member can be fed, one by one, accurately into the inlet port of the hollow needle by the feed mechanism and malfunction hardly occurs. Moreover, clogging of the lock member hardly occurs. The main coiled spring for biasing the arm is twisted so as to provide a dual motion. Accordingly, in the final stage for feeding the lock member by the piston member, a sense of click can be provided, thereby ensuring a more correct feeding operation. Since the attachment device of the present invention is provided with a slip preventing portion, it can effectively be prevented from slipping down from a desktop or the like when it is placed thereon.

DETAILED DESCRIPTION OF THE PREFERRED EMBODIMENT

Figure 1:
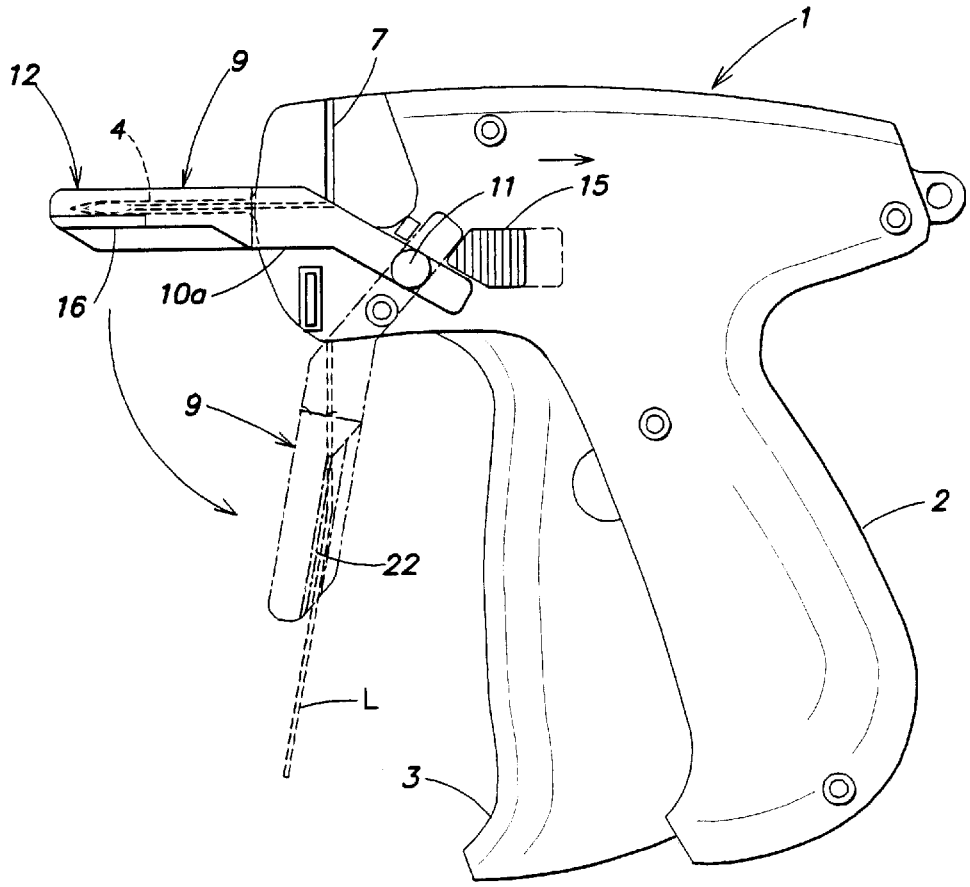
FIG. 1 is a front view of an installation structure of a needle guard incorporated with the present invention.
Figure 2:
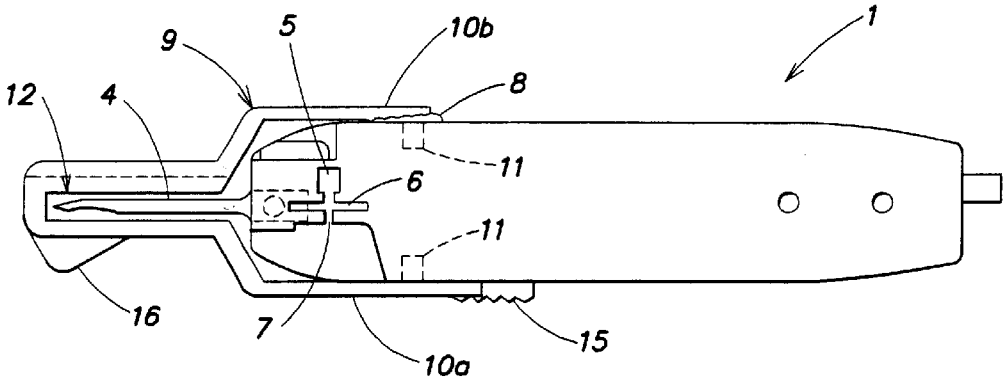
FIG. 2 is a plan view thereof.
Figure 3:
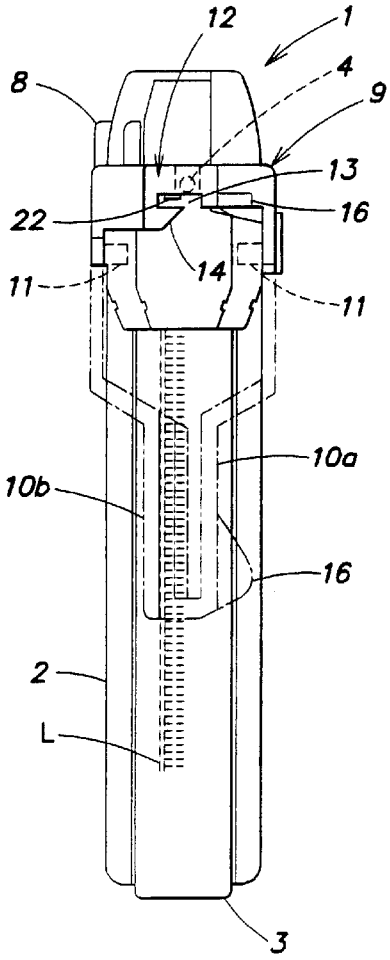
FIG. 3 is a side view thereof.
Figure 4:
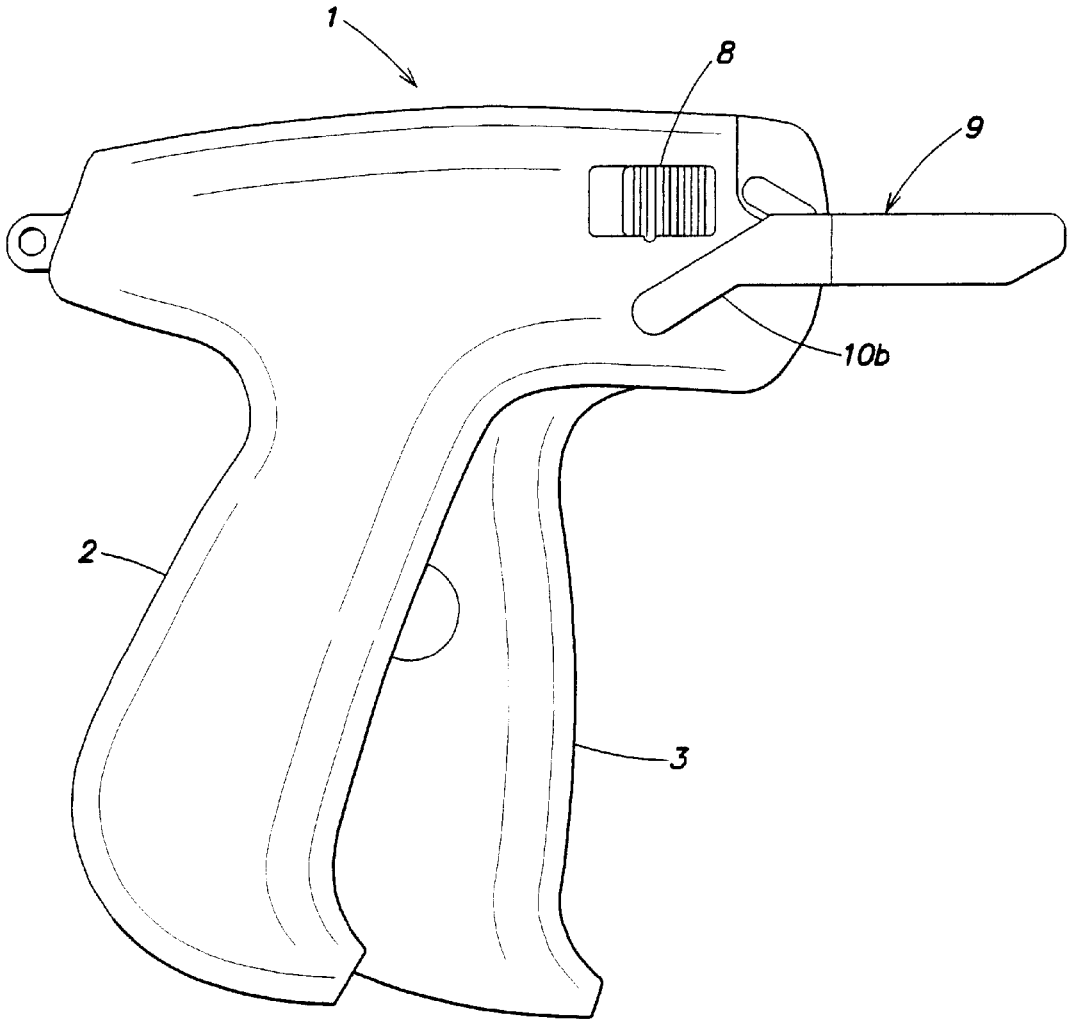
FIG. 4 is a rear view thereof.
Figure 5:
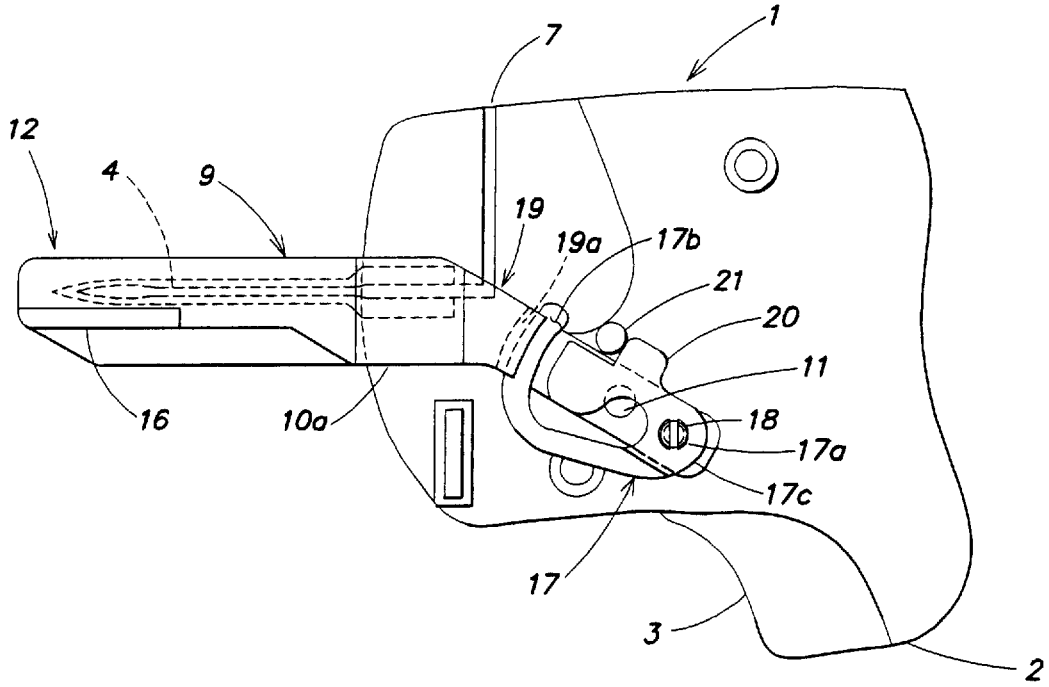
FIG. 5 is a front view showing a second embodiment of the present invention.
Figure 6:
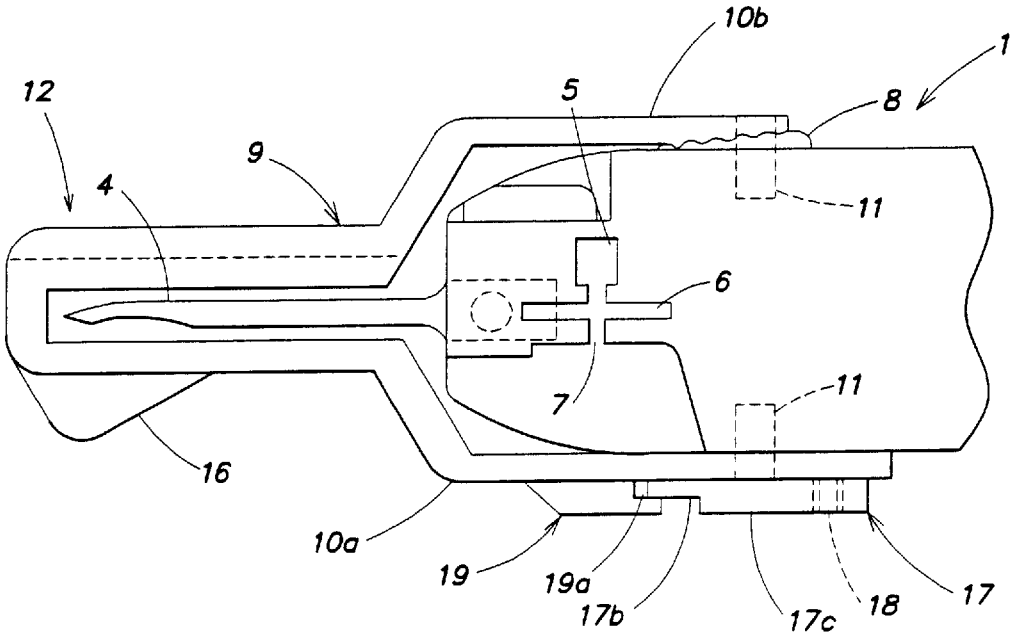
FIG. 6 is a plan view thereof.
Figure 7:
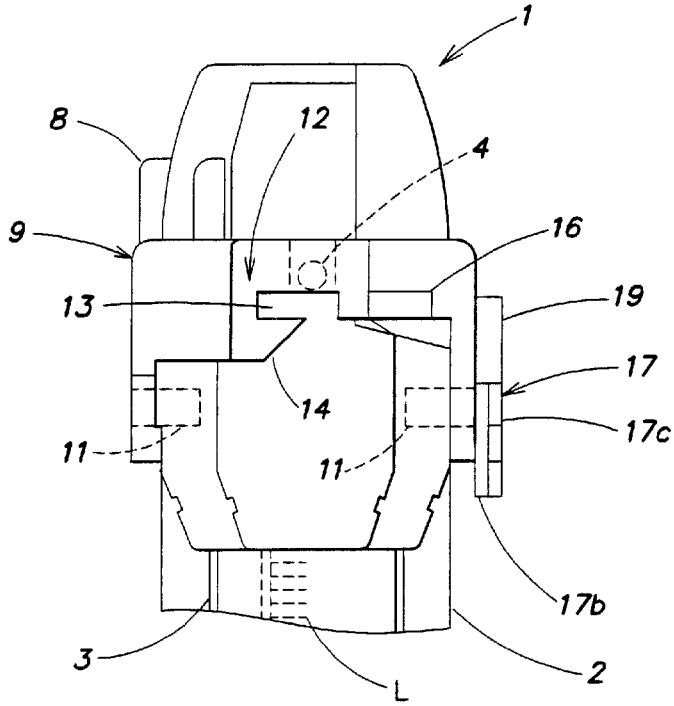
FIG. 7 is a side view thereof.
Figure 8:
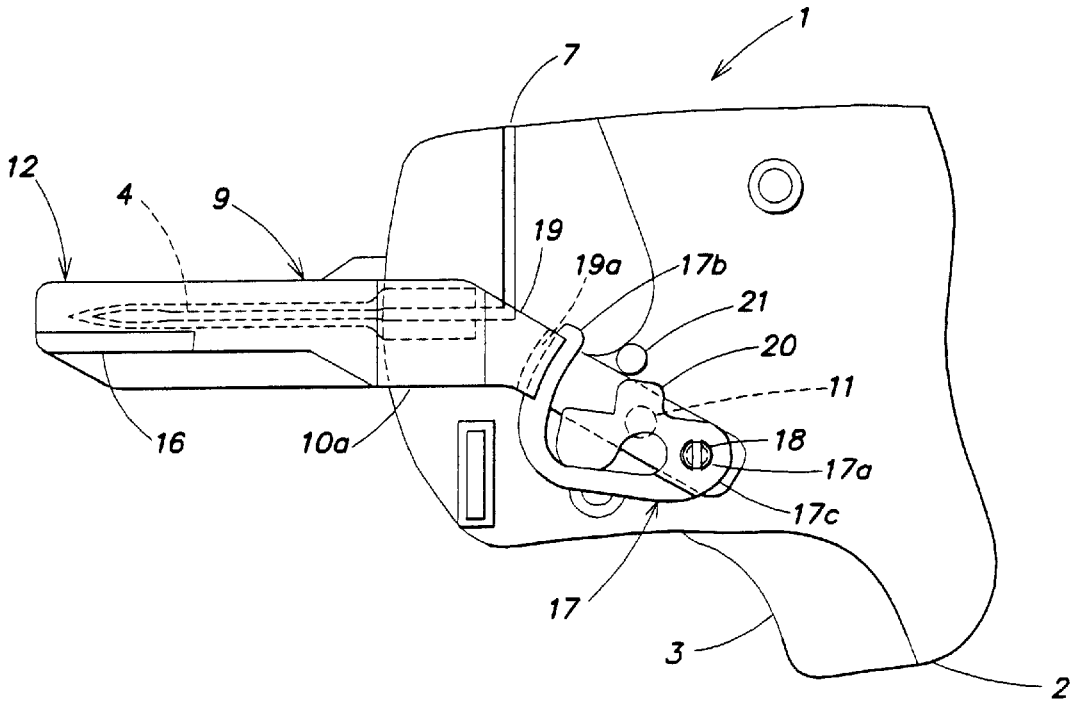
FIG. 8 is a front view showing a released state.
Figure 9:
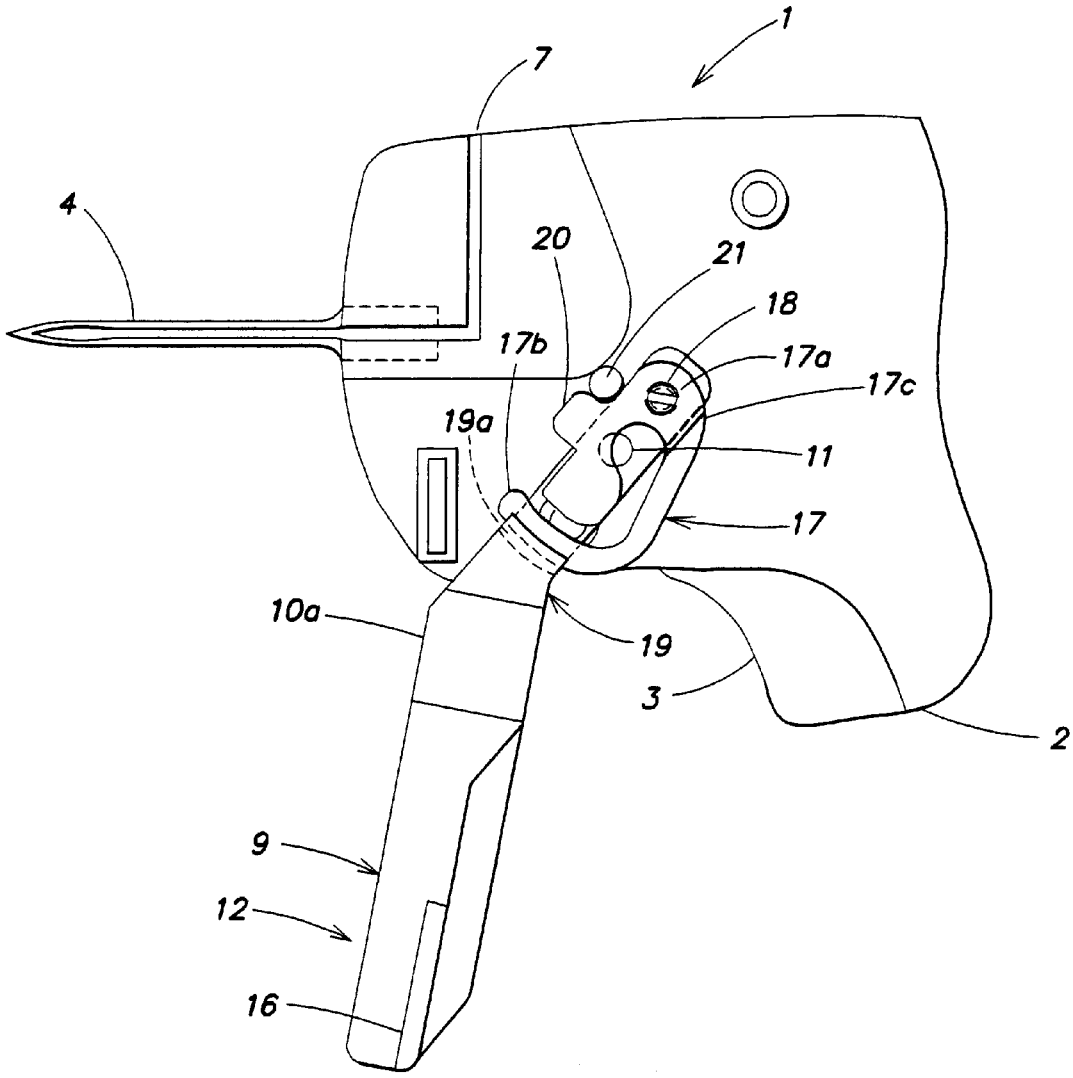
FIG. 9 is a front view showing a state of use as a runner guard.
Figure 10:
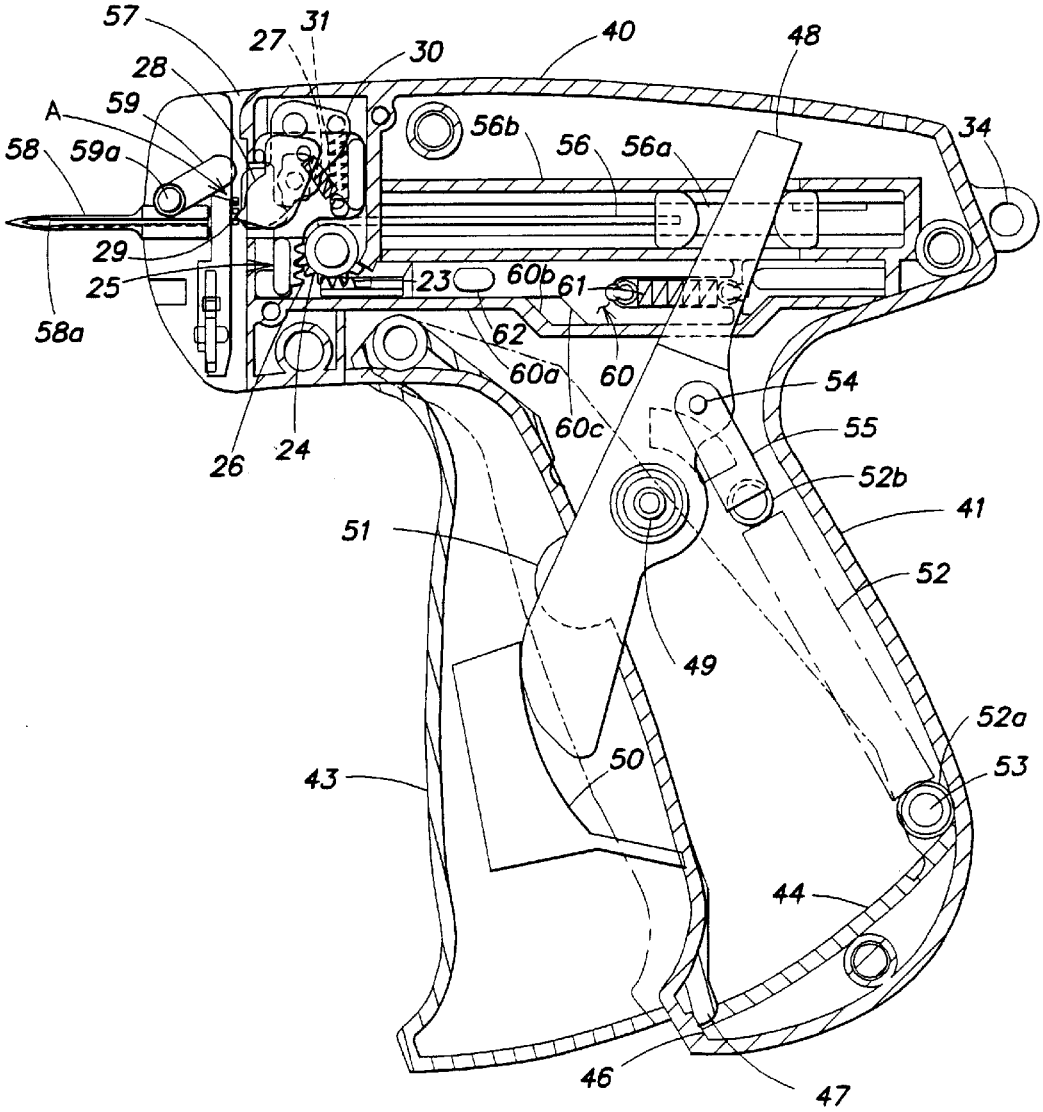
FIG. 10 is a view showing a mechanism of an attachment device of a lock member incorporated with the present invention.
Figure 11:
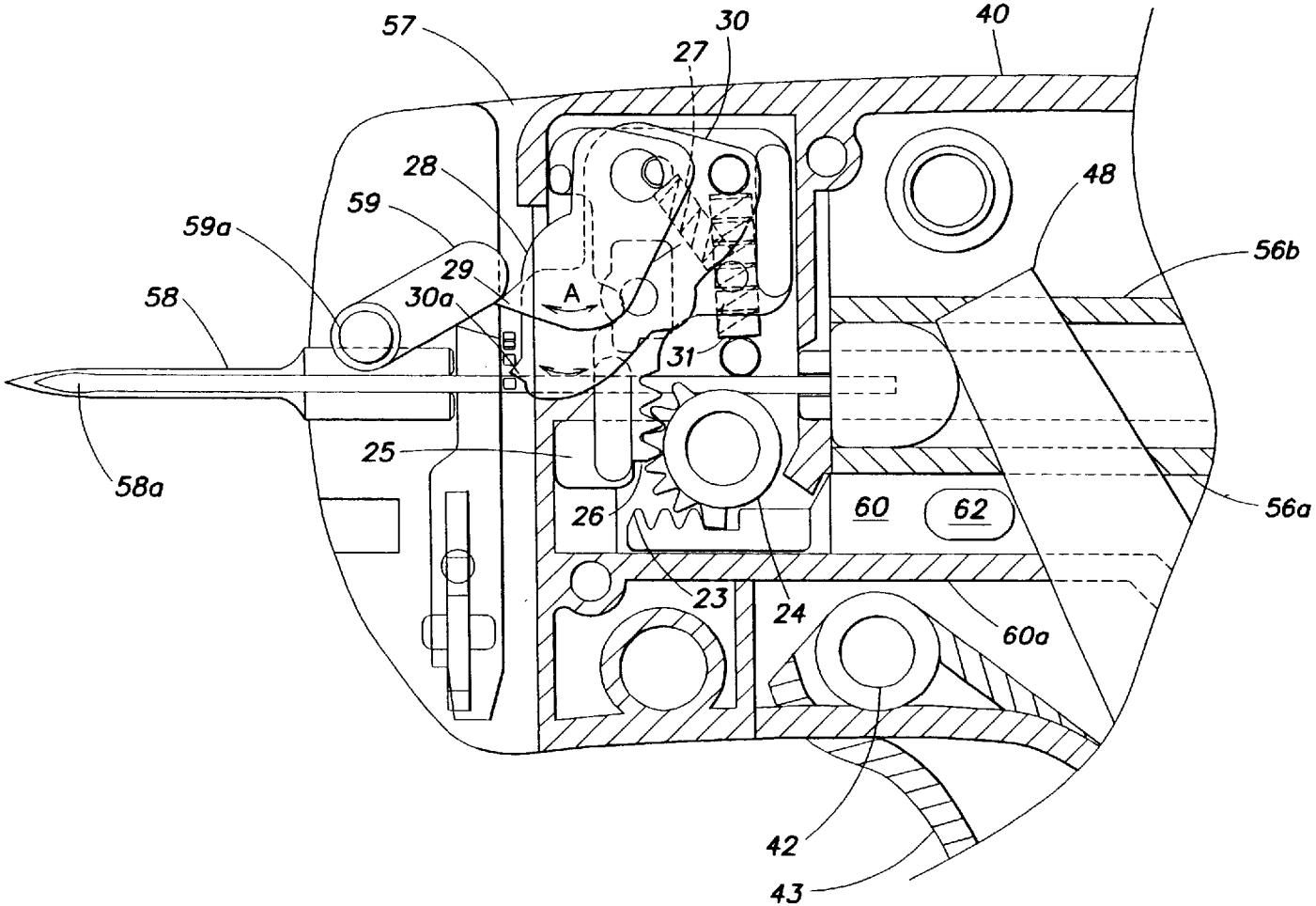
FIG. 11 is an enlarged view showing an operating state of a feed mechanism of an assembly.
Figure 13:
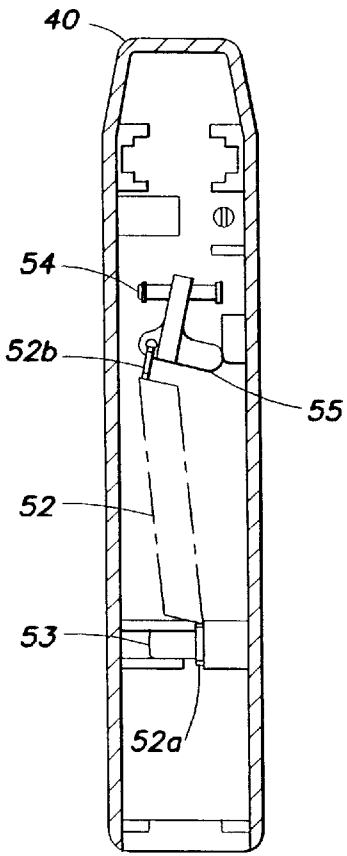
FIG. 13 is a view showing an operating state.
Figure 12:
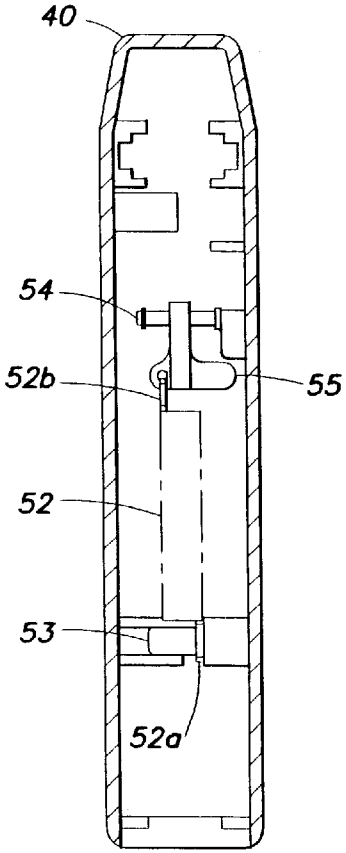
FIG. 12 is a view showing an initial state of a coiled spring for tension biasing an arm.
Figure 14:
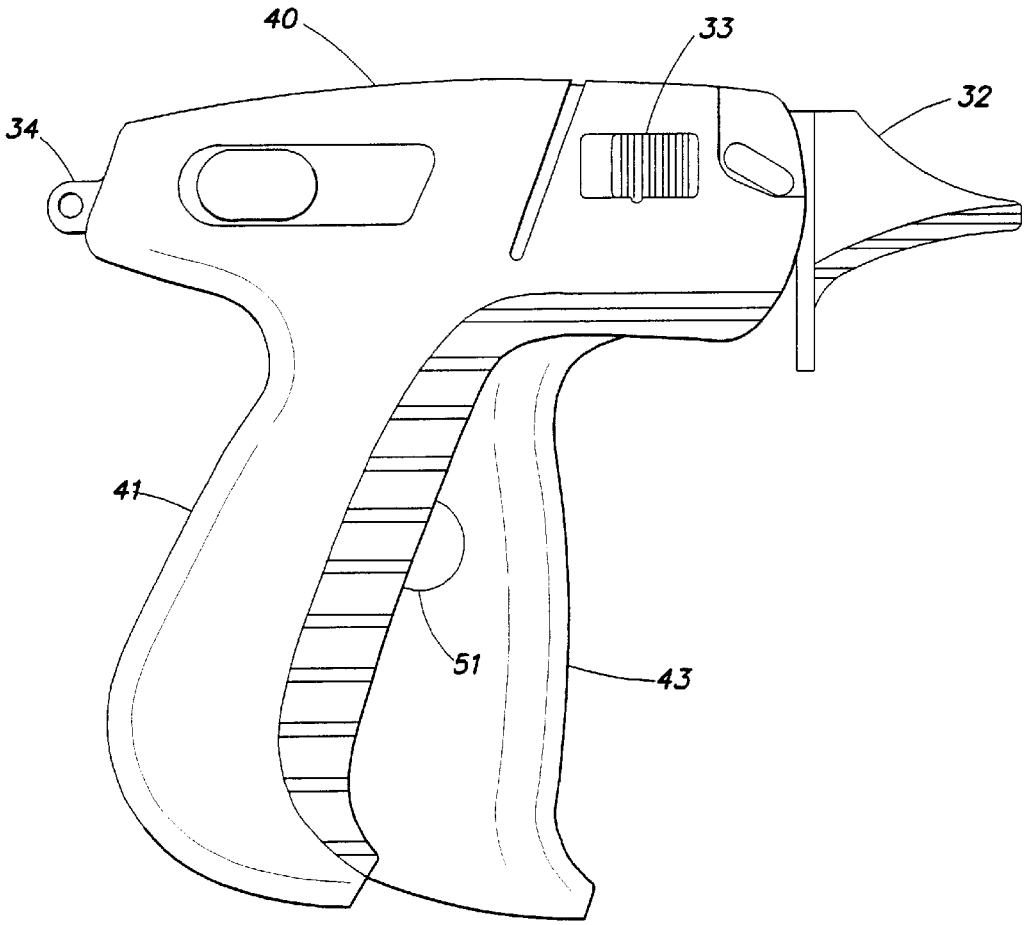
FIG. 14 is a view showing an exterior.

The present invention will now be described in the form of one preferred embodiment with reference to the accompanying drawings, wherein FIG. 1 is a front view of an installation structure of a needle guard incorporated with the present invention, FIG. 2 is a plan view thereof, FIG. 3 is a side view thereof, FIG. 4 is a rear view thereof, FIG. 5 is a front view showing a second embodiment of the present invention, FIG. 6 is a plan view thereof, FIG. 7 is a side view thereof, FIG. 8 is a front view showing a released state, FIG. 9 is a front view showing a state of use as a runner guard, FIG. 10 is a view showing a mechanism of an attachment device of a lock member incorporated with the present invention, FIG. 11 is an enlarged view showing an operating state of a feed mechanism of an assembly, FIG. 12 is a view showing an initial state of a coiled spring for tension biasing an arm, FIG. 13 is a view showing an operating state, and FIG. 14 is a view showing an exterior.

In FIGS. 1–4, reference numeral 1 denotes an attachment device of a suspending member, 2, a grip, 3, a trigger lever, 4, a needle, 5, a runner loading portion of the suspending member, 6, a loading passage of an escape preventing portion, and 7, a loading passage of a fiber portion, respectively. Reference numeral 8 denotes a slide control portion for attached and detaching its suspending member.

Reference numeral 9 denotes a needle guard. This needle guard 9 is integrally provided at a basal portion thereof with a pair of attachment pieces 10*a*, 10*b* each having a fork-like configuration resembling a frog leg. The attachment pieces 10*a*, 10*b* are formed in a parallel-shape which is declined rearward and downward to form an obtuse angle. The attachment piece 10*a* is rather long compared with 10*b* so that it is readily subject to action of a stopper as later described.

The attachment pieces 10*a*, 10*b* have lock pins 11, 11 which are coaxially disposed in opposing relation at areas in the vicinity of basal ends thereof. By those lock pins 11, 11, the attachment pieces 10*a*, 10*b* are pivotally disposed at an area in the vicinity of a front end of a casing which constitutes the attachment device 1.

In front of the attachment pieces 10, 10*b* of the needle guard 9, there is a receiving portion 12 of the needle 4. The receiving portion 12 is formed in a box-like configuration which is open at least at its upper surface.

The receiving portion 12 of the needle 4 has a cut-groove 13 formed in a bottom surface thereof. This cut-groove 13 has a guide taper 14 formed at its inlet portion so that a runner L, which has been fed, can easily be introduced therethrough.

Reference numeral 15 denotes a slider type stopper formed on an outer surface of the casing of the attachment device 1. A slip preventing treatment is applied to the surface of this stopper 15. The stopper 15 is normally biased forward by a coiled spring not shown. The stopper 15 has a chevron shape at a front end thereof. Owing to this feature, when not in use of the attachment device 1, the needle guard 9 is protruded forward to receive the needle in the receiving portion 12 and an upper edge side of the rear end of the attachment piece 10*a* is restrained by a lower edge side of the stopper 15 so as to be correctly positioned. On the other hand, when in use of the attachment device 1 in which the needle guard 9 is collapsed so as to be used as a guard for the runner L, a lower edge side of the rear end of the attachment piece 10*a* is restrained by an upper edge side of the stopper 15 so as to be correctly positioned. This positioning can be released by sliding the stopper 15 in the arrowed direction of FIGURES against the biasing direction.

Reference numeral 16 denotes a control portion disposed at an outer surface of the receiving portion 12 and adapted to cause the needle guard 9 to make a pivotal movement. Reference numeral 22 denotes a runner stopper disposed at an inner surface of the cut groove 13. This runner stopper 22 is formed by a bent piece, a swollen portion or the like which has a spring property. The runner stopper 22 is for preventing the runner portion L from falling and scattering in nearby area of the working spot with a weak resisting force when the runner portion L of the used-up tag suspending member assembly passes.

A second embodiment of the present invention will now be described with reference to FIGS. 5 through 9. Those parts and components of FIGS. 5 through 9 which are common to the above-mentioned first embodiment shown in FIGS. 1–9 are denoted by like reference numerals In this embodiment, a stopper 17 is fixed at a rear end portion thereof to the area of the surface of an attachment piece 10*a* offset to the rear end by a fixing element such as a minus pin 18 or the like. The fixing of the stopper 17 is conducted by fitting a through hole to a head portion of the minus pin 18 and press fitting an engagement portion 17 *a* disposed across the through hole to a groove formed in a head portion of the minus pin 18. In this way, the stopper 17 can easily be attached and detached.

Since this stopper 17 is formed in a generally reversed vortical shape from an elastic material such as plastics, it can exhibit a strong spring property as a whole by forming its front end portion 17*b* thin and its rear end portion 17*c* generally twice as thick as the front end portion 17*b*.

The thin front end portion 17*b* of the stopper 17 is lockingly fitted to a receiving groove 19*a* formed in the rear end of a receiving portion formed on an outer surface of the attachment piece 10*a*. On the other hand, the thick rear end portion 17*c* of the stopper 17 has a generally rectangular press control and lock portion 20 integrally formed on and projecting from its upper part.

Reference numeral 21 denotes an engagement receiving pin projecting from the attachment device 1. When not in use of the attachment device 1, the needle guard 9 is protruded forward to allow the needle 4 to be received in the receiving portion 12, and the front edge side of the press control and lock portion 20 is engaged with the engagement receiving pine 21 so as to be correctly positioned. On the other hand, when in use of the attachment device 1, the engaged state is released by pushing the press control and lock portion 20 inward, thereby allowing the needle guard 9 to make a pivotal movement. At that time, the pressing force of the press control and lock portion 20 is received, as a stress, by the front end portion 17*b* of the stopper 17.

Thus, the needle guard 9 is pivotally moved and collapsed so as to serve as a guard for the runner L. At that time, when the pressing force applied to the press control and lock portion 20 is released, the rear end portion 17*c* of the stopper 17 is restored and the rear edge side of the press control and lock portion 20 is engaged with the engagement receiving pin 21 to make a correct positioning in that condition. According to the second embodiment of the present invention, the stopper 17 can be detached without being remained in the attachment device. Of course, the needle guard 9 itself can be attached and detached, as in the first embodiment, by removing the lock pins 11, 11.

In FIGS. 10 through 14, the reference numeral 40 denotes a casing. This casing 40 includes a grip portion 41 integrally formed thereon. This grip portion 41 is open at its front surface. A trigger lever 43 is pivotally supported at its upper end by the open portion through a pin 42. The trigger lever 43 is pivotally moved with its lower end slidingly contacted with a guide 44 which is disposed at a lower part of the grip 41. A stepped stopper 46 disposed at a front end of the guide 44 is abutted with an engagement portion 47 disposed at a rear portion of a lower end of the trigger lever 43 so as to prevent escape.

Reference numeral 48 denotes an arm. This arm 48 is pivotally supported at its area lower than its center by a pin 49 so that the arm 48 can turn. A front surface of a lower end of this arm 48 is in an arc shape and is abutted with a press control portion 50 formed on the trigger lever 43. The arc-shaped lower end front surface of the arm 48 is slidingly pushed by the press control portion 50, so that the arm 48 can turn about the pin 49. Reference numeral 51 denotes a cut formed in the rear surface of the trigger lever 43 and adapted to avoid the collision of the pin 49.

The arm 48 in an initial state of FIG. 10 is tension biased by a main coiled spring 52. This main coiled spring 52 has rings 52*a*, 52*b* for supporting the main coiled spring 52 thereon. The rings 52*a*, 52*b* are vertically arranged in a point symmetrical relation. The lower ring 52*a* is hooked on a pin 53 disposed at the grip portion 41 for aligning the casing 40, while the upper ring 52*b* is eccentrically hooked on a lower end of a coiled spring connector 55 whose upper portion is fitted to a pin 54 pierced through the arm 48.

Owing to the above-mentioned constitution, when the pin 54 is shifted in accordance with the turning motion of the arm 48, a load applied to the main coiled spring 52 serves to pull up the ring 52*b* side and a spring connector 55 is tilted thereby twisting the coiled spring 52 with the help of pressing force coming from a rear surface of the arm 48. This twisting of the coiled spring 52 provides a heavy sense of control, thus providing a sense of click occurrable in a final stage for press feeding an escape preventing rod portion of the lock member to a back side of an objective matter by a piston member as later described. As a result, correctness of the working is enhanced.

An distal end of the arm 48 is inserted in a through hole 56*a* which is formed in a rear end of a piston member 56 which is received in a slide guide 56*b*. Thus, when the arm 48 is turned against the biasing force of the main coiled spring 52, the piston member 56 is press fed forward. This piston member 56 crosses a loading portion 57 of an assembly A of a lock member which is disposed near the front end of the device in an up and down direction and is then inserted into a hollow needle 58 disposed at the distal end.

The hollow needle 58 is provided at its side with a slit 58*a*. This slit 58*a* allows a filament of the engagement member pushed and cut from the assembly A by the piston member 56 to pass therethrough. Reference numeral 59 denotes an escape preventing member of the assembly A which is pivotally supported by a pin 59*a* disposed at the loading portion 57 of the assembly A.

Reference numeral 60 denotes a slider member received in a slide guide 60*a*. This slider member 60 is normally tension biased backward at its rear end by a coiled spring 61. The slider member 60 has an engagement projection 62 formed on its side surface near its front. The arm 48, when turned, pushes the engagement projection 62 at the time near the end of its turning movement, so that the slider member 60 is pushed forward against the biasing force of the coiled spring 61. This advancement is stopped when a swollen portion 60*c* comes into collision with a stepped portion 60*b* formed on a slide guide 60*a*.

The slider member 60 has a rack 23 formed on an upper surface of its distal end. A final groove of the rack 23 has a larger pitch than others. The rack 23 is engaged with a pinion member 24 which is pivotally supported on its upper portion. Engaged by the rack 23, the pinion member 24 is turned. The teeth of the pinion member 24 are formed only on a portion of the peripheral surface which is 180 degrees or less. The final tooth of the pinion member 24 is dimensioned large so as to be engaged with the final groove of the rack 23.

The pinion member 24 is engaged also with a rack 26 which is formed on a rear surface of a lower end of an elevating member 25 which is disposed at a front portion. The rack 26, when turned, causes the elevating member 25 to lift upward.

One end of the coiled spring 27 is hooked on a rear end of the elevating member 25, and the other end (upper end) of the coiled spring 27 is hooked on a rear portion of an upper end of a feed member 28 of the assembly A. The feed member 28 is caused to move upward and downward and to make a pivotal movement by the biasing force of the coiled spring 27. That is, the trigger lever 43 is triggered to push the piston member 56 and the slider member 60 is slidingly moved to cause the elevating member 25 to move upward. At that time, a feed claw 29 formed on a distal end of a lower portion of the feed member 28 is once pivotally moved away from the connector members of the assembly A. At the time the elevator member 25 is moved to the uppermost limit, the feed claw 29 is once again brought between the connector members by the force of the coiled spring 27. And at the time of being restored into its initial state, the assembly A is fed downward.

Reference numeral 30 denotes a return preventing member of the assembly A. An upper portion of a rear end of the return preventing member 30 is tension biased between the inner surface projection of the casing 1 and the return preventing member 30 by a coiled spring 31 so that a lower end of the return preventing member 30 is pivotally moved by the coiled spring 31. That is, a restraining claw 30*a* which is formed on a front portion of a lower end of the return preventing member 30 and which restrains the connector member of the assembly A in the initial state is once pivotally moved away under the effect of the coiled spring 31. And at the time one piece of all individual pieces forming the assembly A is fed by the feed claw 29, the restraining claw 30*a* restrains once again the connector member, thereby retaining the fed state.

FIG. 14 shows an outer appearance of the device. Reference numeral 32 denotes a cover for a hollow needle 58. The cover 32 is set when not in use. Reference numeral 33 denotes a control portion for controlling an escape preventing member 59 at the time of setting or detaching of the assembly A. Reference numeral 34 denotes an attachment portion of a strap when the entire device is suspended on a hook or the like.

Reference numeral 35 denotes a slip preventing portion which is swollen on an outer surface of the casing 1. This slip preventing portion 35 is formed from a material such as plastics which is soft and which has a strong frictional force. Since the slip preventing portion 35 is swollen out, the slip preventing portion 35 is necessarily contacted with a desktop face when the casing 1 is placed on a desktop. Accordingly, it can effectively be prevented that the casing 1 is slipped down from the desktop.

An installation structure of a needle guard according to the present invention is constructed in the above-mentioned manner. Accordingly, the structure is compact and simple. Merely by simple operation for actuating the stopper, a guard from the needle at the time of non-use and a guard from contact between the runner and the user's finger at the time of use can be switched from one to the other. That is, the needle guard as a single member is always effective irrespective of use or non-use of the attachment device. Since the structure is simple, there is no fear that the device gets out of order. Moreover, the device can be offered to users at a low price.

Since the sliding motion (lateral direction) of the slider member can correctly be converted into a vertical direction by gear transmission, the assembly can be fed accurately and malfunction hardly occurs. Moreover, clogging of the lock member hardly occurs. The main coiled spring for biasing the arm is twisted so as to provide a dual motion. Accordingly, in the final stage for feeding the lock member by the piston member, a sense of click can be provided, thereby ensuring a more correct feeding operation. Since the attachment device of the present invention is provided with a slip preventing portion, it can effectively be prevented from slipping down from a desktop or the like when it is placed thereon.

What is claimed is:

1. A lock member attachment device comprising:

a needle having a slit along at least a portion thereof;

a piston member operatively engageable with at least a portion of the slit of the needle;

a trigger lever;

an arm operatively engageable with the trigger lever for actuating the arm to engage the piston member to actuate the piston member to engage the needle; and a feed mechanism which provides a lock member to the needle, the feed mechanism comprising:

a pinion member having teeth engageable for rotation with a rack which is formed on an upper surface of a front end of a slider member which is tension biased by a spring and actuated by the arm, an elevating member on which the rack is formed and which is engaged by said pinion member, and a feed claw member pivotally moved in accordance with movement of said elevating member.

2. The lock member attachment device according to claim 1, wherein teeth of said pinion member are formed on a surface having 180 degrees or less of a main body peripheral surface.

* * * * *